US010857051B2

(12) United States Patent
Sauser et al.

(10) Patent No.: US 10,857,051 B2
(45) Date of Patent: Dec. 8, 2020

(54) OCCUPANT SUPPORT AND MATTRESS WITH IMMERSION SENSING CAPABILITY AND METHODS OF MANAGING BLADDER PRESSURE IN THE OCCUPANT SUPPORT AND MATTRESS

(71) Applicant: Hill-Rom Services, Inc., Batesville, IN (US)

(72) Inventors: Frank E. Sauser, Cincinnati, OH (US); Marwan Nusair, Cincinnati, OH (US); Nicholas C. Batta, Batesville, IN (US); James D. Voll, Columbus, IN (US)

(73) Assignee: Hill-Rom Services, Inc., Batesville, IN (US)

( * ) Notice: Subject to any disclaimer, the term of this patent is extended or adjusted under 35 U.S.C. 154(b) by 306 days.

(21) Appl. No.: 15/608,056

(22) Filed: May 30, 2017

(65) Prior Publication Data

US 2018/0228678 A1 Aug. 16, 2018

Related U.S. Application Data

(60) Provisional application No. 62/474,887, filed on Mar. 22, 2017, provisional application No. 62/459,690, filed on Feb. 16, 2017.

(51) Int. Cl.
*A61G 7/057* (2006.01)
*A47C 27/08* (2006.01)

(52) U.S. Cl.
CPC ..... *A61G 7/05776* (2013.01); *A47C 27/08* (2013.01)

(58) Field of Classification Search
CPC ..... A61G 7/05738; A61G 7/05746; A61G 7/05753; A61G 7/05761; A61G 7/05769; A61G 7/05776; A61G 7/05784; A61G 7/05792; A47C 27/08; A47C 27/082; A47C 27/083; A47C 27/085; A47C 27/10
See application file for complete search history.

(56) References Cited

U.S. PATENT DOCUMENTS 4,907,845 A 3/1990 Wood
5,509,154 A * 4/1996 Shafer ..... A47C 27/082 318/16
6,025,782 A 2/2000 Newham
6,034,526 A 3/2000 Montant et al.
(Continued)

OTHER PUBLICATIONS

A New Body Shape Index Predicts Mortality Hazard Independently of Body Mass Index; Open Access Freely available online; PLOS one | www.plosone.org; Jul. 2012 | vol. 7 | Issue 7 | e359504.
(Continued)

*Primary Examiner* — Nicholas F Polito
*Assistant Examiner* — Rahib T Zaman
(74) *Attorney, Agent, or Firm* — Kenneth C. Baran

(57) ABSTRACT

An occupant support system includes a framework, a mattress supported by the framework and having at least one bladder, an electromagnetic signal source, and an electromagnetic signal receiver. The receiver is spaced from the occupant facing side of the mattress. The signal source is configured to direct an electromagnetic signal at a target. The signal receiver is configured to receive a return signal from the target in response to the directed signal. The system also includes a processor adapted to determine immersion of the target as a function of the information content of the return signal.

13 Claims, 15 Drawing Sheets

(56) References Cited

U.S. PATENT DOCUMENTS

| | | | | |
|---|---|---|---|---|
| 6,517,106 | B1 | 2/2003 | Stanley et al. | |
| 6,560,804 | B2 | 5/2003 | Wise et al. | |
| 6,772,639 | B2 | 8/2004 | Seals | |
| 6,778,090 | B2 | 8/2004 | Newham | |
| 6,825,765 | B2 | 11/2004 | Stanley et al. | |
| 6,943,694 | B1 | 9/2005 | Ellis | |
| 8,102,270 | B2 | 1/2012 | Gowda et al. | |
| 8,296,887 | B2 | 10/2012 | Doehler et al. | |
| 8,397,326 | B2 * | 3/2013 | Lafleche | A61G 7/05761 5/706 |
| 8,437,876 | B2 * | 5/2013 | Receveur | A61G 7/002 700/275 |
| 8,707,483 | B2 * | 4/2014 | Richards | A61H 23/00 340/4.34 |
| 8,726,908 | B2 | 5/2014 | Squitieri | |
| 8,757,165 | B2 * | 6/2014 | Squitieri | A61F 5/34 128/892 |
| 9,044,367 | B2 | 6/2015 | Yakam et al. | |
| 9,468,307 | B2 | 10/2016 | Lafleche et al. | |
| 9,711,029 | B2 * | 7/2017 | Ribble | G08B 21/0461 |
| 9,820,904 | B2 * | 11/2017 | Lafleche | A61G 7/05715 |
| 2005/0200489 | A1 | 9/2005 | Sloop et al. | |
| 2006/0244466 | A1 | 11/2006 | Call et al. | |
| 2011/0185509 | A1 | 8/2011 | Genaro | |
| 2013/0019408 | A1 * | 1/2013 | Jacofsky | A47C 27/083 5/613 |
| 2013/0104312 | A1 | 5/2013 | O'Reagan | |
| 2015/0000045 | A1 | 1/2015 | Lafleche et al. | |
| 2016/0242562 | A1 * | 8/2016 | Karschnik | A47C 27/084 |
| 2016/0324707 | A1 * | 11/2016 | Lachenbruch | A47C 27/082 |

OTHER PUBLICATIONS http://www.joyofclothes.com/style-advice/shape-guide/body-shapes-overview.php; Feb. 10, 2017; What is my body? What to wear for my body shape | Joy of Clothes.

* cited by examiner

OCCUPANT SUPPORT AND MATTRESS WITH IMMERSION SENSING CAPABILITY AND METHODS OF MANAGING BLADDER PRESSURE IN THE OCCUPANT SUPPORT AND MATTRESS

CROSS REFERENCE TO RELATED APPLICATIONS

This application claims priority to U.S. provisional applications 62/459,690 filed on Feb. 16, 2017 and 62/474,887 filed on Mar. 22, 2017, the contents of both of which are incorporated herein by reference

TECHNICAL FIELD

The subject matter described herein relates to occupant supports, such as beds used in health care settings, and particularly to an occupant support having the capability to determine occupant immersion into bladders of the mattress portion of the occupant support. The subject matter described herein also includes methods of managing bladder internal pressure. The methods may alternatively be thought of as methods of managing the risk of skin damage to the occupant or as methods of regulating occupant immersion into a mattress.

BACKGROUND

Beds of the type used in health care settings include a framework and a mattress supported on the framework. The framework comprises multiple, longitudinally distributed sections. Some of the sections are orientation adjustable relative to each other. The mattress is designed to flex in order to accommodate the various orientations of the framework sections. Such beds also include siderails along the left and right sides of the bed. The siderails are positionable in an "UP" or deployed position so that they extend vertically above the top of the mattress. The siderails are also positionable in a "DOWN" or stowed position at which the top of the siderail is vertically lower than the top of the mattress in order to facilitate occupant ingress and egress. Such beds also include a control system to regulate and coordinate the operation of various bed components including the orientation adjustable framework sections.

Some mattresses include bladders which contain a fluid, usually air, pressurized sufficiently to support the occupant of the bed. The bladders deform under the weight of the occupant so that the occupant "sinks" into the mattress. The extent to which the occupant sinks into the mattress is referred to as immersion. As a general rule the occupant's immersion increases with decreasing bladder internal pressure and vice versa. Also as a general rule, contact area between the occupant and the mattress is smaller when the bladder is more highly pressurized (less occupant immersion) and greater when the bladder is less highly pressurized (more occupant immersion).

Occupant immersion has both benefits and drawbacks. One benefit relates to interface pressure, which is the pressure exerted on the occupant's skin as a result of his weight being borne by the mattress. For an occupant of a given weight, the larger contact area arising from greater immersion results in lower interface pressure. Lower interface pressures help to mitigate the occupant's risk of developing interface pressure related skin abnormalities such as pressure ulcers. This specification uses pressure ulcers as a non-limiting example of skin abnormalities whose likelihood of occurrence may be reduced by the support methods and apparatuses described herein.

One drawback of increased immersion is the risk that the occupant will sink so far into the mattress that he is essentially in contact with the rigid framework beneath the mattress. This is referred to as "bottoming out". Bottoming out not only reduces occupant comfort but also causes at least localized regions of unacceptably large interface pressure. The high interface pressures can promote the development of pressure ulcers.

Bed manufacturers include design features to reduce the likelihood of bottoming out and/or to reduce its adverse effects. For example a manufacturer may provide a layer of foam between the framework and the bladders. If the occupant sinks too far into the bladders his weight bears on the foam. This can be thought of as the occupant bottoming out on the foam, or as the occupant encountering a barrier to bottoming out on the framework. Either way, the foam conforms to the occupant's body to provide more contact area than would be the case if the occupant bottomed out on the framework. Therefore the foam provides more comfort and mitigates the risk of pressure ulcer development. However the foam layer adds cost to the bed and introduces a flammability risk.

The foam layer also introduces challenges to the design of the siderails. When deployed, the siderails must extend a minimum specified distance above the top of the mattress. When stowed, the top of the siderail must be below the top of the mattress, and the bottom of the siderail must be a minimum required distance from the floor. The foam layer increases the vertical distance from the top of the framework to the top of the mattress and therefore complicates the task of accommodating these requirements.

Bed manufacturers also face the problem of regulating occupant immersion depending on the orientation of the orientation adjustable sections of the framework. For example the framework may include an orientation adjustable torso section. When an occupant is properly positioned on the bed his torso corresponds to (i.e. is approximately longitudinally coextensive with) the torso section of the bed. Changes in the angular orientation of the torso section affect the occupant's weight distribution on the mattress. As a result, the manufacturer may furnish the bed control system with an algorithm which adjusts internal bladder pressure depending on occupant weight and the orientation angle of the torso section. However because the algorithm operates without knowledge of the occupant's actual immersion, the algorithm is intentionally conservative by design. That is, the algorithm provides a safety margin by specifying a bladder pressure higher than would be the case if the occupant's actual immersion were known. As a result the ability of the mattress to provide the lowest possible interface pressure, and therefore the best protection against pressure ulcers may be impaired.

What is needed are cost effective products and methods which provide improved protection against the development of pressure ulcers and reduce the risk of bottoming out.

SUMMARY

An occupant support system described herein includes a framework, a mattress supported by the framework, an electromagnetic signal source, an electromagnetic signal receiver, and a processor. The signal receiver is spaced from the occupant facing side of the mattress. The signal source is configured to direct an electromagnetic signal at a target. The signal receiver is configured to receive a return signal from target, which return signal is in response to the directed signal. The processor is adapted to determine immersion of the target as a function of the information content of the return signal.

An embodiment of the occupant support system described herein includes a framework, a mattress supported by the framework, an RFID interrogator mounted on the framework, and a processor. The interrogator is configured to direct a signal at an RFID tag associated with the occupant facing side of the mattress and to receive a return signal from the RFID tag in response to the directed signal. The processor is adapted to determine immersion of the RFID tag as a function of the frequency at which a signal strength extremum, such as a valley or trough, is present in the return signal.

A method of managing bladder pressure in one or more support bladders of an occupant support described herein includes the steps of:

1) determining immersion of an occupant of the occupant support;
2) comparing the immersion to a desired immersion; and
3a) if the immersion is greater than the desired immersion, increasing internal pressure in at least one of the support bladders; and
3b) if the immersion is less than the desired immersion, decreasing internal pressure in at least one of the support bladders.

A related method of managing the risk of skin damage to an occupant of an occupant support includes the steps of:

1) directing an electromagnetic signal at a target;
2) monitoring for a return signal from the target in response to the directed signal; and
3) if the return signal is not detected, decreasing internal pressure in at least one of the one or more support bladders until the return signal is detected.

A related method of managing the risk of skin damage to an occupant of an occupant support includes:

1) sequentially directing a series of electromagnetic signals of different frequencies from a signal source to an occupant of the occupant support
2) receiving return signals reflected from the target in response to the directed signal;
3) determining the frequency at which the return signals exhibit a signal strength extremum;
4) establishing actual occupant immersion based on the determined frequency; and
4) if the established immersion is greater than a desired immersion, increasing internal pressure in at least one of the support bladders until the established immersion matches the desired immersion; and
5) if the signal strength of the return signal is less than the desired immersion, decreasing internal pressure in at least one of the support bladders until the established immersion matches the desired immersion.

Another related method of managing the risk of skin damage to an occupant of an occupant support includes:

1) sequentially directing a series of RFID signals of different frequencies from an RF source at an RFID tag whose spacing from the RF source varies as a result of occupant immersion into the one or more bladders;
2) receiving return signals from the RFID tag in response to the directed signals, each return signal containing information revealing the strength, as received at the RFID tag, of whichever directed signal it is associated with;
3) establishing actual occupant immersion based on the reported strength; and
4) if the established immersion is greater than a desired immersion, increasing internal pressure in at least one of the support bladders until the established immersion matches the desired immersion; and
5) if the signal strength of the return signal is less than the desired immersion, decreasing internal pressure in at least one of the support bladders until the established immersion matches the desired immersion.

A mattress described herein includes at least one bladder, an electromagnetic signal source and an electromagnetic signal receiver.

BRIEF DESCRIPTION OF THE DRAWINGS

The foregoing and other features of the various embodiments of the occupant support system, mattress and methods described herein will become more apparent from the following detailed description and the accompanying drawings in which.

DETAILED DESCRIPTION

Figure 1:
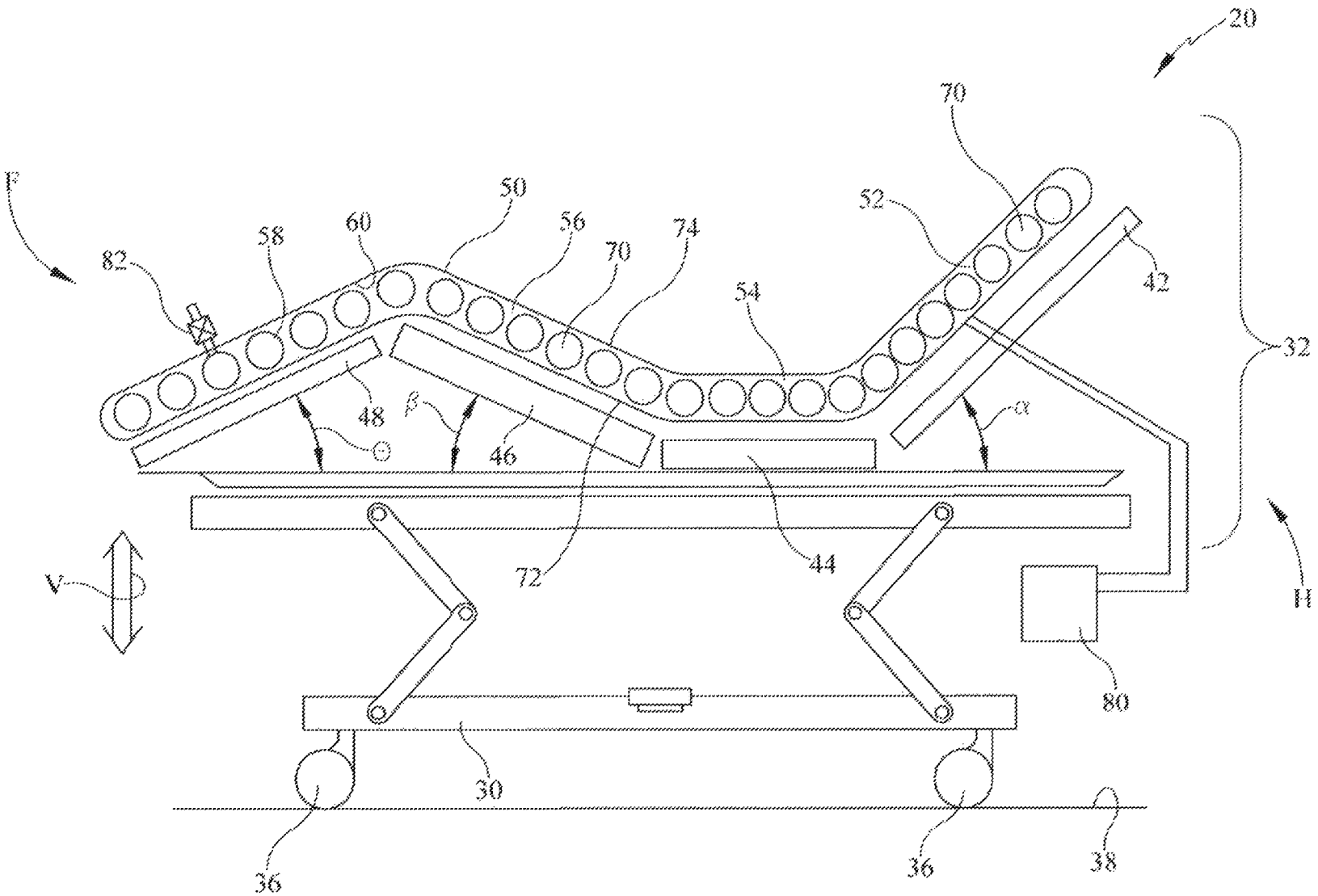
FIG. 1 is a schematic left side elevation view of a hospital bed.

Reference will now be made to embodiments of the invention, examples of which are illustrated in the accompanying drawings. Features similar to or the same as features already described may be identified by the same reference numerals already used. The terms "substantially" and "about" may be used herein to represent the inherent degree of uncertainty that may be attributed to any quantitative comparison, value, measurement or other representation. These terms are also used herein to represent the degree by which a quantitative representation may vary from a stated reference without resulting in a change in the basic function of the subject matter at issue.

Figure 2:
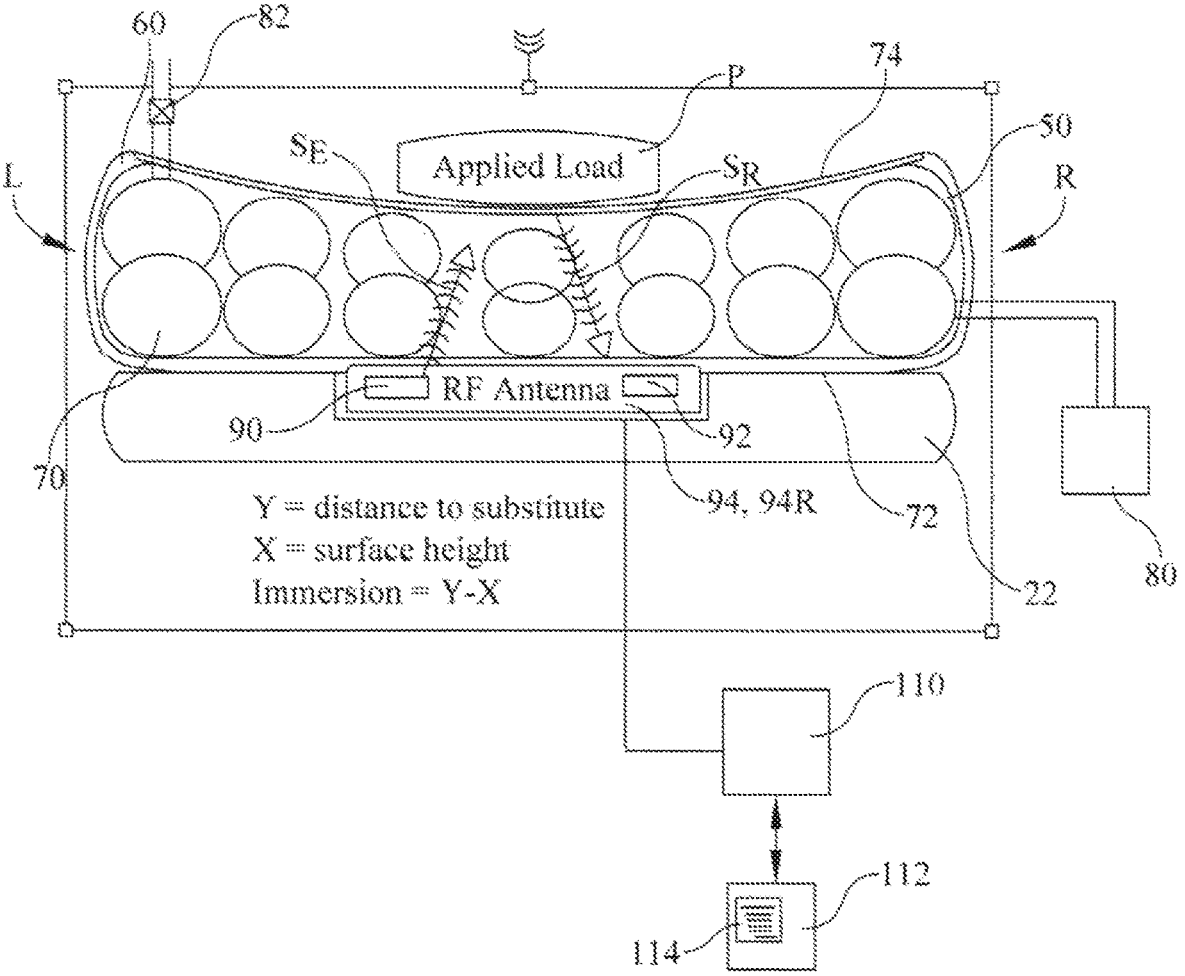
FIG. 2 is a schematic head end cross sectional view of a hospital bed showing an interrogator, such as an RFID interrogator, mounted on a framework of the bed, a mattress, a signal source, a signal emitted from the signal source, a return signal arising from reflection of the emitted signal off a target (illustrated as bed occupant or patient P), a processor, a memory, and instructions contained in the memory and executable by the processor for determining immersion of the target into the mattress.

Referring to FIGS. 1 and 2 an occupant support system includes an occupant support illustrated as a hospital bed 20. The bed or occupant support includes a framework 22. The framework includes at least a base frame 30 and an elevatable frame 32 which is vertically moveable relative to the base frame as indicated by directional arrow V. The bed extends longitudinally from a head end H to a foot end F and laterally from a left side to a right side. As used herein, left and right are taken from the vantage point of a supine bed occupant. Casters 36 extend from the base frame to floor 38.

The elevatable frame 32 includes a deck which includes an upper body or torso section 42 corresponding approximately to the torso of an occupant properly positioned on the bed. The upper body section is orientation adjustable through an angle $\alpha$ from a substantially horizontal orientation (0°) to a more vertical orientation. The deck also includes a lower body section corresponding approximately to the occupant's buttocks, thighs and calves. The lower body section may be thought of as comprising a seat section 44 corresponding approximately to an occupant's buttocks, and a leg section. The leg section may be thought of as comprising a thigh section 46 corresponding approximately to an occupant's thighs, and a calf section 48 corresponding approximately to an occupant's calves and feet. The thigh and calf sections are orientation adjustable through angles $\beta$ and $\theta$ respectively from a substantially horizontal orientation (0°) to a less horizontal orientation.

Bed 20 also includes a mattress 50 supported by the framework. The mattress has an upper body or torso segment 52, a seat segment 54, a thigh segment 56 and a calf segment 58, each corresponding approximately to an occupant's torso, buttocks, thighs and calves. A ticking 60 envelops the bladders so that the bladders are enclosed within the ticking. The mattress rests on or is affixed to the elevatable frame in any suitable manner such that the mattress segments flex or bend to allow the mattress to change angular orientation in concert with any change in the angular orientation of a corresponding deck section. Because the angular orientation of each mattress segment is substantially the same as that of the corresponding deck section, the angle symbols $\alpha$, $\beta$ and $\theta$ are used to denote orientations of both a deck section and its corresponding mattress segment.

The mattress includes one or more bladders 70. The mattress of FIG. 1 is illustrated as being comprised essentially entirely of laterally extending bladders having a circular cross section. The mattress of FIG. 2 is illustrated as being comprised essentially entirely of longitudinally extending bladders having a circular cross section. However the subject matter described and claimed herein is not limited to any particular bladder geometry, or any particular bladder orientation, and includes mattresses having bladders of different designs and/or orientations. The subject matter described and claimed herein also extends to mattress architectures having both bladders and components other than bladders, for example foam.

A pump 80 is connected to the bladders. The pump supplies pressurized air to pressurize or inflate the bladders. The pump may also be operated in reverse to depressurize or deflate the bladders. Alternatively or additionally one or more vent valves 82 may be provided to depressurize the bladders. In the interest of simplifying the drawings, the pump is illustrated as being connected to a single bladder. In practice the pump (or multiple pumps) is in fluid communication with all the bladders whose internal pressure the designer of the system wishes to adjust. Examples of ways this can be done include interbladder fluid passages, a piping system extending to each bladder, or by a piping system extending to groups of interconnected bladders.

Mattress 50 has a framework facing side 72 which faces the framework. Specifically the framework facing side faces and is in close proximity to the deck sections 42, 44, 46, 48. The mattress also has an opposite, occupant facing side 74 which faces an occupant or patient P, and is in close proximity to the occupant when the occupant occupies the bed.

The occupant support system also includes an electromagnetic signal source or emitter 90 and an electromagnetic signal receiver 92. At least the receiver is spaced from the occupant facing side of the mattress. As illustrated, signal source 90 and signal receiver 92 are components of an interrogator 94, one example of which is an RFID interrogator 94R whose emitter 90 emits RF electromagnetic radiation and whose receiver 92 receives a return signal from the target. In the embodiment of FIG. 2, the interrogator is mounted on the framework. Because the signal source and signal receiver are components of interrogator 94 (or 94R) in FIG. 2, they can likewise be considered to be mounted on the framework, as distinct from being components of the mattress. The emitter and transmitter may be collocated, using the same antenna to transmit and receive simultaneously. Alternatively, separate emitting and receiving antennas may be used, either collocated within the same circuit board or in two separate locations.

Signal source 90 is configured to emit an electromagnetic signal $S_E$ and to direct the signal at a target. The signal may therefore be referred to as either the directed signal or as the emitted signal. Signal receiver 92 is configured to receive a return signal $S_R$ from the target in response to the directed signal. In FIG. 2 the target is the occupant P of the occupant support, and the return signal is a reflected signal. That is, the return signal is the reflection, from the occupant, of the emitted or directed signal.

The occupant support system also includes a processor 110 and a memory 112 containing machine readable instructions 114 for the processor. The processor is adapted to execute the machine readable instructions in order to determine the immersion of the target as a function of the return signal $S_R$. In the example of FIG. 2, the mattress has a non-deformed height of Y, which is the vertical distance from the signal receiver to the top of the mattress when the mattress is not deformed. When an occupant occupies the mattress, the deformed height, shown as X, is the vertical distance from signal receiver 92 to the target, which in FIG. 2 is the occupant P. Immersion is the difference, Y−X. Alternatively, reference distance Y may be a baseline height $Y_{BASE}$ other than the undeformed height Y. In one example the baseline height Y is a deformed height, for example the height corresponding to a baseline or standard occupant, in which case, $Y_{BASE}$−X would be interpreted as a positive or negative deviation from the baseline.

Figure 3:
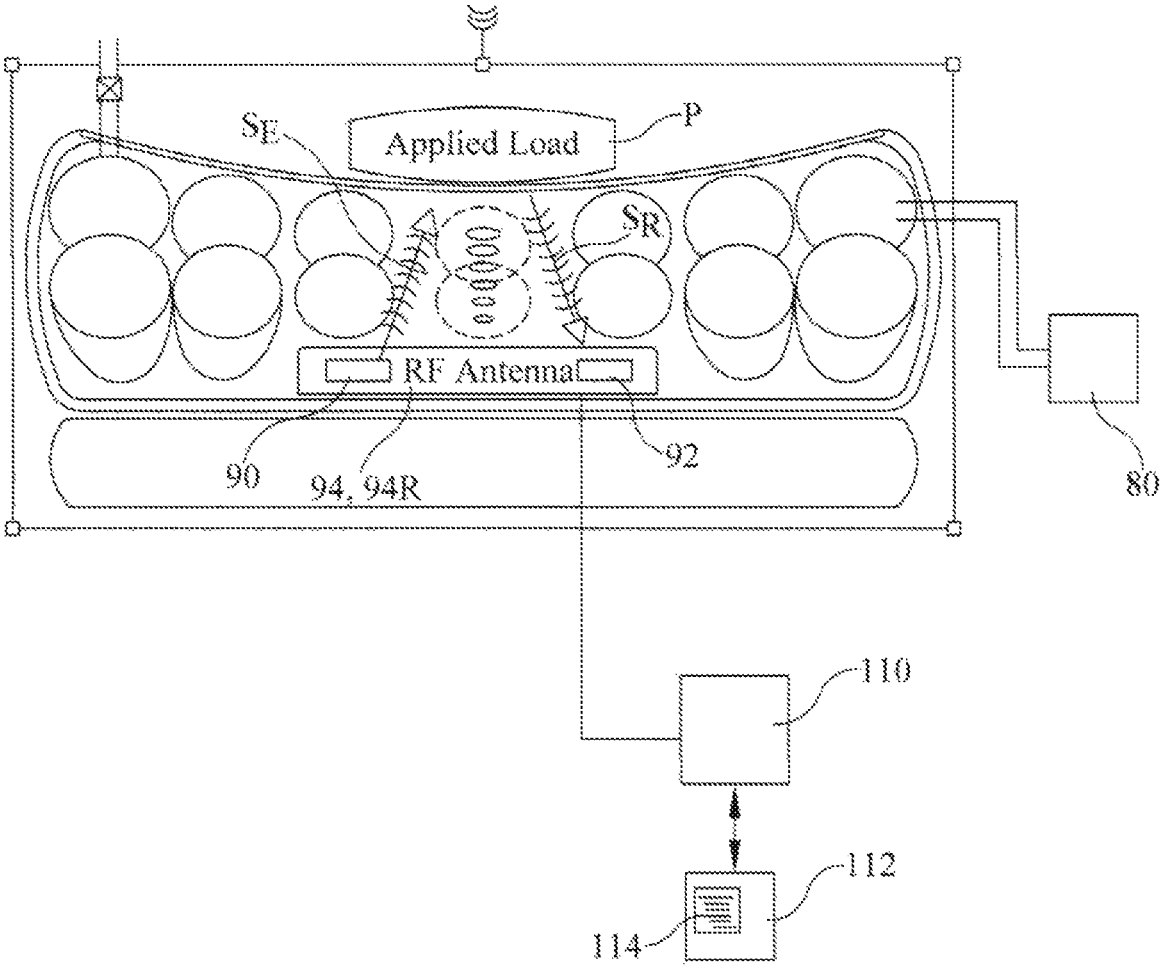
FIG. 3 is a schematic head end cross sectional view of a hospital bed similar to that of FIG. 2 in which the interrogator is a component of the mattress by virtue of being inside the mattress ticking rather than being mounted on the framework as in FIG. 2.

FIG. 3 shows an embodiment similar to that of FIG. 2 except that the signal source and signal receiver are inside the mattress ticking, rather than mounted on the framework as in FIG. 2, and can therefore be considered components of the mattress. However like the embodiment of FIG. 2, the source and receiver are components of an interrogator 94, one example of which is an RFID interrogator 94R.

FIGS. 4A-4D elaborate on a methodology for establishing the actual immersion of the target as a function of return signal $S_R$, including the methodology carried out by the processor when it executes the machine readable instructions. When referring to the actual immersion this specification may use terms such as "established" and "determined" interchangeably with "actual". Those skilled in the art will understand that because of measurement inaccuracy the determined or established immersion may differ from the actual immersion, but will be nevertheless be a sufficiently accurate representation of the actual immersion.

Figure 4A:
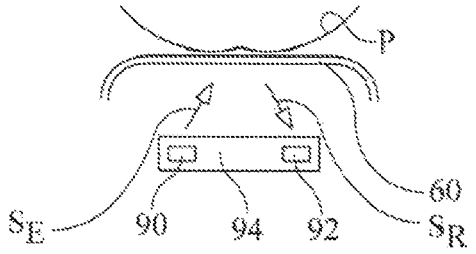
FIG. 4A is a schematic view similar to that of FIG. 2 showing an emitted signal $S_E$ and a return signal $S_R$ in which the return signal is the reflection of the emitted signal from occupant P.
Figure 4B:
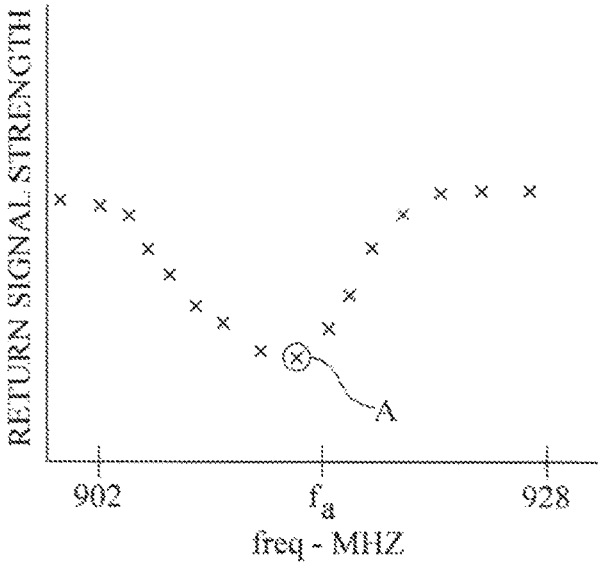
FIG. 4B, is a graph of return signal strength versus frequency showing, for an occupant at a given immersion, a trough or valley in the reflected signal strength of FIG. 4A.

FIG. 4A is a schematic similar to that of FIG. 2 showing an emitted signal $S_E$ and a return signal $S_R$ in which the return signal is the reflection of the emitted signal from occupant P. The information content of the signal includes its strength. In the illustrated methodology, interrogator 94 carries out a frequency scan by sequentially emitting electromagnetic signals of uniform strength at each of a number of different frequencies (for example at 50 different frequencies in the 902 to 928 megahertz band). FIG. 4B, shows, for an occupant at a given immersion, the strength of the return signal received at receiver 92 for each of the emitted signals, plotted as a function of frequency. The frequency $f_A$ at which the return signal strength is a minimum (point A) is an indication of the occupant's immersion into the mattress.

Figure 4C:
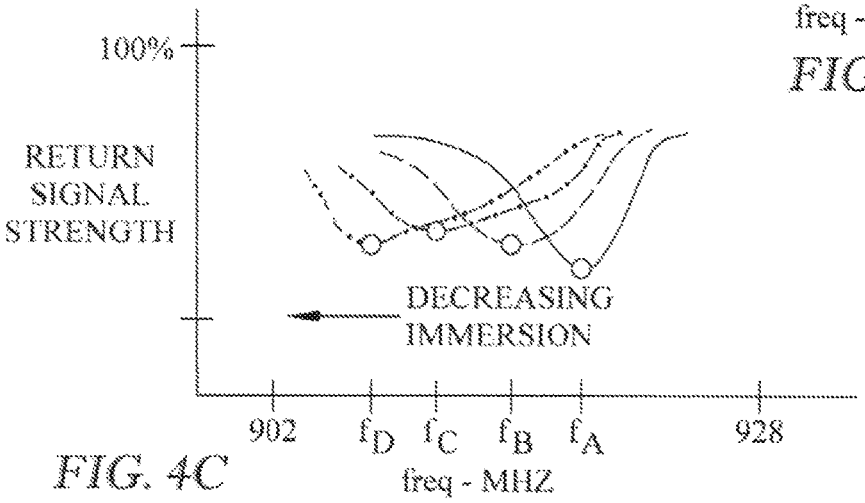
FIG. 4C is a graph showing a curve fit corresponding to the data points of FIG. 4B and an additional curve fit for each of three additional occupant immersions.
Figure 4D:
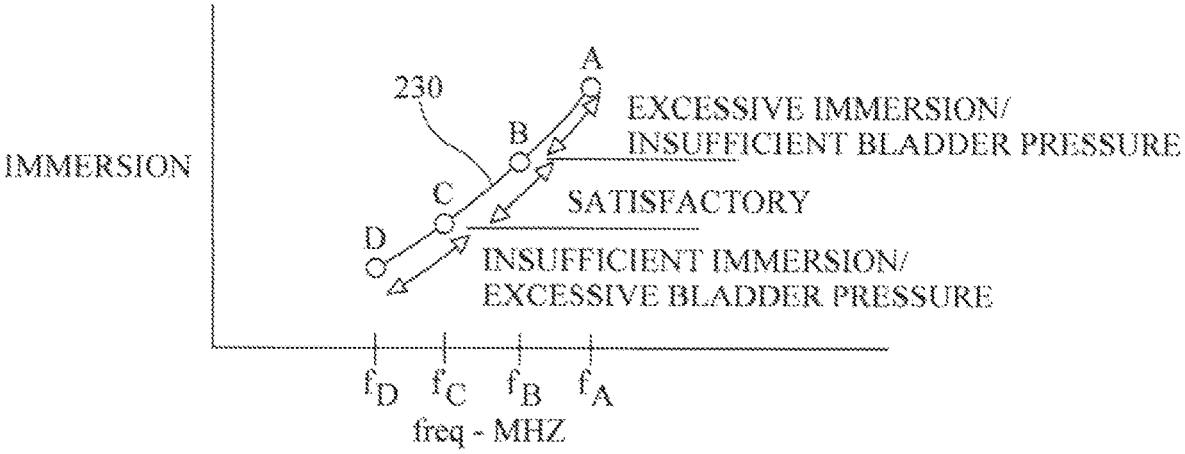
FIG. 4D is a graph showing immersion as a function of the valley frequencies of FIG. 4C.

FIG. 4C is a graph showing a curve fit through the data points of FIG. 4B (solid line) and similar curve fits for occupant immersions other than that of FIG. 4B. Points B (dashed line), C (dash-dot line), and D (double-dash, double-dot line) are the points of minimum return signal strength for those other occupant immersion depths. FIG. 4D is a graph in which the immersion depths corresponding to the minima or valleys have been plotted against frequency. A curve 230 fit through the points enables occupant immersion to be determined (for example by processor 110) as a function of the frequency at which a signal strength valley is present in the return signal In FIG. 4C, the minimum return signal strength is shown as generally increasing slightly with decreasing values of the frequency at which the minimum strength return signal occurs. However other behaviors may manifest themselves. For example FIG. 4C as depicts the signal strength at $f_D$ as being lower than at $f_C$. In another example the RFID system may be tuned so that the signal strength valley occurs at higher frequencies as immersion decreases. In addition, various measures of signal strength such as but not limited to RSSI (Received Signal Strength Indicator) and intensity (power per unit area) can be used to carry out the methods described herein.

Figure 5:
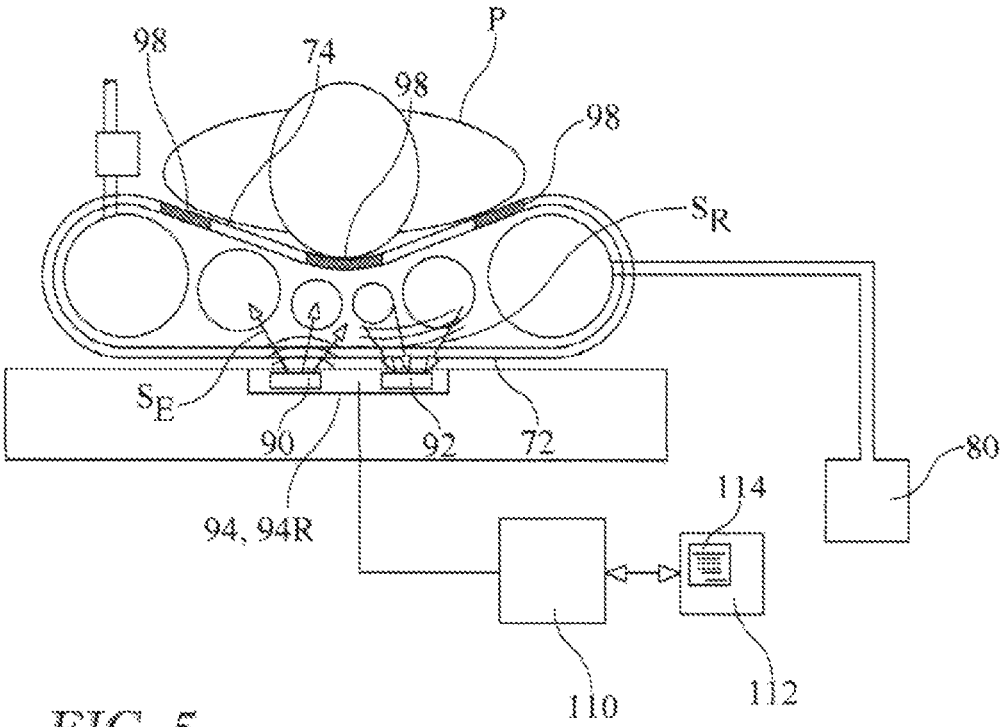
FIG. 5 is a schematic head end cross sectional view of a hospital bed similar to that of FIG. 2 in which the interrogator is mounted on the bed framework and the target is a non-occupant of the bed, for example an RFID tag.

FIG. 5 shows an embodiment similar to that of FIG. 2 except that the target is a non-occupant of the bed. As used herein, "non-occupant" means an object other than the patient. The illustrated non-occupant target is at least one tag 98, for example an RFID tag. As illustrated, the tags are associated with the occupant facing side 74 of the mattress, for example by being sandwiched between inner and outer ticking layers on the occupant facing side of the mattress or by being otherwise attached to the ticking on the occupant facing side of the mattress. The distance between the signal receiver 92 and a given tag 98 decreases with increasing immersion of occupant P. Stated more generally, the target of FIG. 5 is a mattress component whose spatial relationship relative to the signal receiver depends on the attributes of a distributed load applied to the mattress and the fluid pressure inside bladders 70. An example attribute of the distributed load is the way the load is distributed, e.g. spread out over a relatively large area or concentrated in a relatively small area. The distribution of the load will affect how deeply the load (bed occupant) is immersed which, in turn, will affect the distance between the RFID tag and the RFID receiver.

Figure 6:
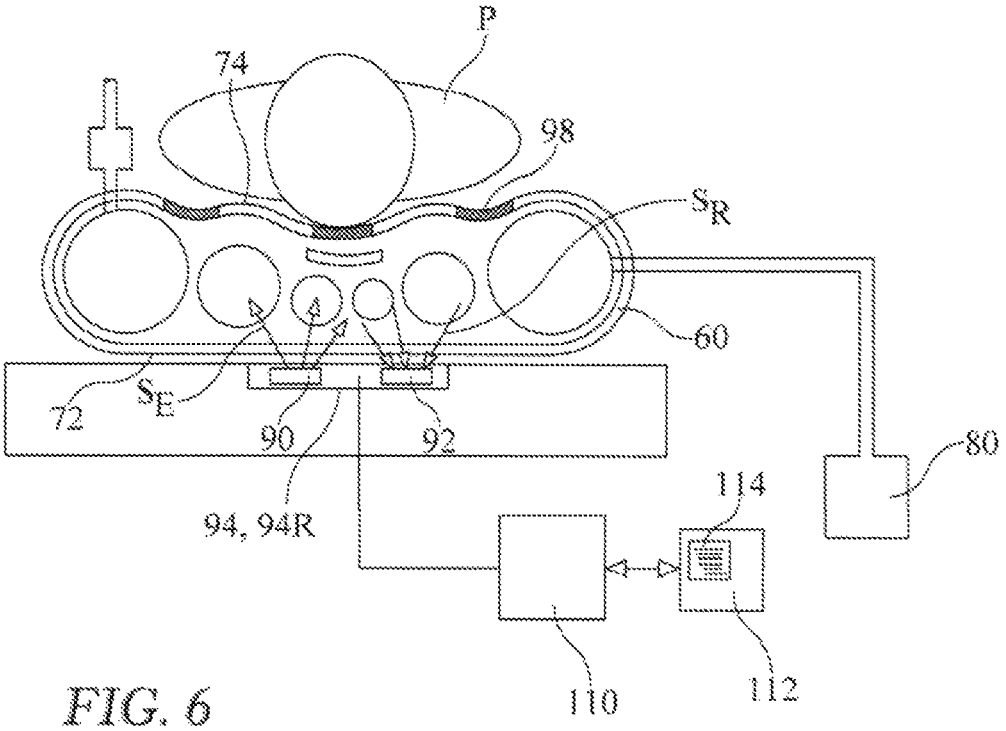
FIG. 6 is a schematic head end cross sectional view of a hospital bed similar to that of FIG. 6 in which the interrogator is a component of the mattress by virtue of being inside the mattress ticking rather than being mounted on the framework as in FIG. 6.

FIG. 6 shows an embodiment similar to that of FIG. 5 except that both the signal source and signal receiver are inside mattress ticking 60, rather than mounted on the framework as in FIGS. 2 and 5, and can therefore be considered components of the mattress. However like the embodiment of FIG. 6, the source and receiver are components of an interrogator 94, one example of which is an RFID interrogator 94R. Accordingly, the mattress shown in FIG. 6 comprises at least one bladder 70, a ticking 60, an electromagnetic signal source or emitter 90 such as an RF source, and an electromagnetic signal receiver 92. The mattress has a framework facing side 72 and an occupant facing side 74. The framework facing side and the occupant facing side are considered to be present even when the mattress is not installed on a framework because the occupant facing side is intended to face the occupant whereas the framework facing side is intended to face the framework, and the two sides are distinctive from each other so that an observer can tell which side is which. The mattress also includes a target 98, for example one or more RFID tags, vertically separated from the signal source. The target is sandwiched between inner and outer ticking layers on the occupant facing side of the mattress or is otherwise attached to the ticking on the occupant facing side of the mattress. Signal source 90 and receiver 92 are closer to the framework facing side of the mattress than to the occupant facing side, and target 98 is closer to the occupant facing side of the mattress than to the framework facing side.

Yet another option, not illustrated, is to affix one or more RFID tags to the occupant or the occupant's sleepwear at places on the occupant's body or sleepwear that are expected to face the occupant facing side of the mattress whenever the occupant occupies the mattress. Such a tag, although affixed to the occupant or sleepwear, can nevertheless be considered to be associated with the occupant facing side of the mattress because of its positioning at places on the occupant's body or sleepwear that are expected to face the occupant facing side of the mattress whenever the occupant occupies the mattress. In the case of multiple occupant-affixed tags or sleepwear-affixed tags, the tag closest to the occupant facing side of the mattress (as a result of whether the occupant is supine, prone or lying on his side) is expected to have more utility for the purposes described herein than would be the case for the other tags.

Figure 7A:
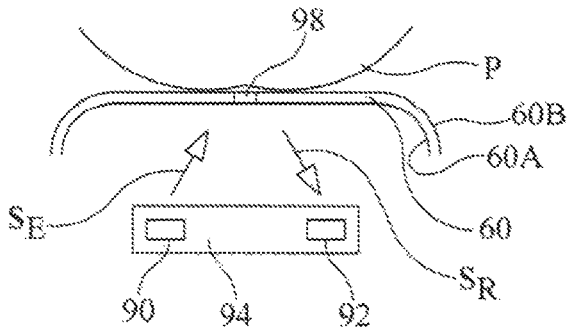
FIG. 7A is a schematic view similar to that of FIG. 4A showing an emitted signal $S_E$ and a return signal $S_R$ in which the return signal is a reporting signal from an RFID tag sandwiched between inner and outer layers of a mattress ticking and in which the return signal reports the strength of the emitted signal as received at the RFID tag.
Figure 7B:
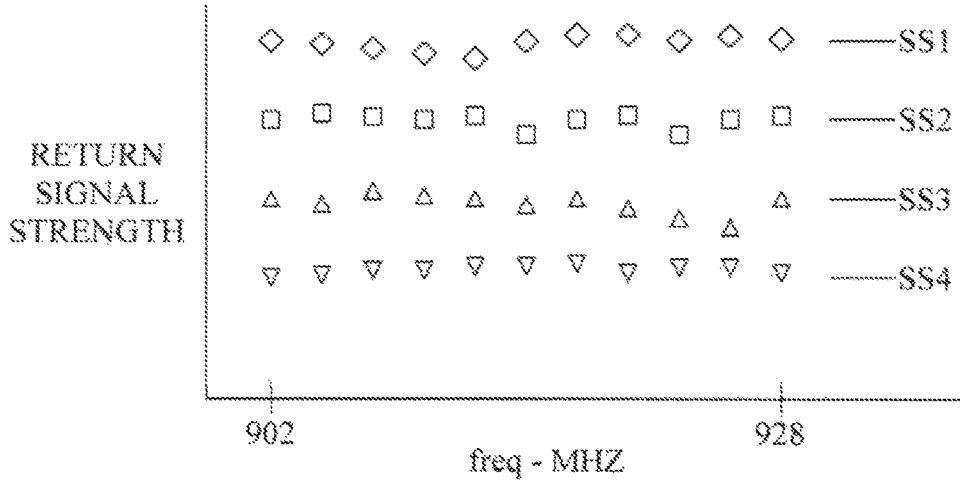
FIG. 7B, shows, for an occupant at each of four given immersions, the reported signal strength of FIG. 4A as a function of frequency, and an average reported signal strength at each of the four immersions.
Figure 7C:
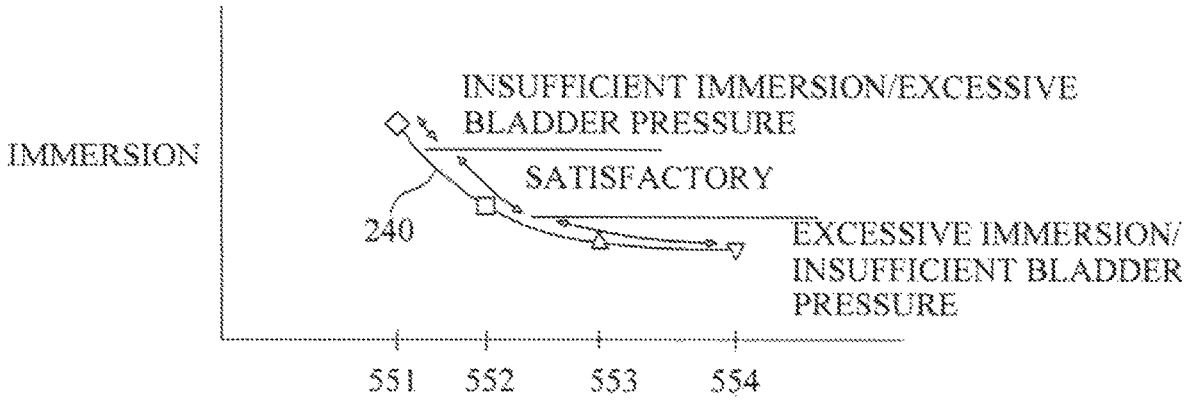
FIG. 7C is a graph of occupant immersion plotted against the average signal strength of FIG. 7B and a curve fit through the signal strength data points.

FIGS. 7A-7C elaborate on another methodology for establishing the actual immersion of the target as a function of return signal $S_R$, including the methodology carried out by the processor when it executes the machine readable instructions. The principal difference between the method of FIGS. 4A-4D and that of FIGS. 7A-7C is that the former method uses a reflection of the emitted signal from the occupant to indicate occupant immersion, and indicates occupant immersion by the frequency $f_A$ at which the return signal strength is a minimum, whereas the latter method uses a report of the strength of the directed signal as received at the RFID tag, and indicates occupant immersion as a function of the reported strength.

FIG. 7A is a schematic similar to that of FIG. 4A but also showing an RFID tag 98 sandwiched between inner and outer ticking layers 60A, 60B. Return signal $S_R$ is a report from the RFID tag of the strength of the emitted signal $S_E$ as received at the tag. In the illustrated methodology interrogator 94 carries out a frequency scan by sequentially emitting electromagnetic signals of uniform strength at each of a number of different frequencies (for example at 50 different frequencies in the 902 to 928 megahertz band). FIG. 7B, shows, for an occupant at each of four given immersions, the strength of the return signal reported by the tag to receiver 92 for each of the emitted signals. Because the reported signal strength may vary from frequency to frequency, an average of the reported signal strengths at each level of occupant immersion ($SS_1$, $SS_2$, $SS_3$, $SS_4$) is determined. FIG. 7C is a graph of occupant immersion plotted against the average signal strength. The curve fit 240 through the points enables occupant immersion to be determined (for example by processor 110) as a function of reported signal strength.

Figure 8:
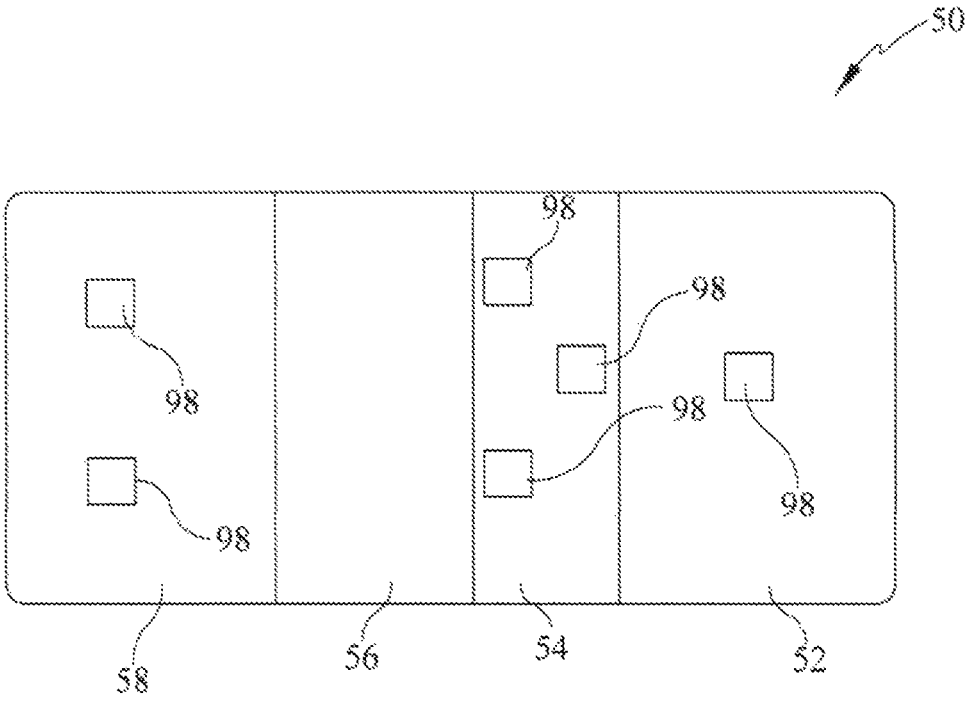
FIG. 8 is a schematic plan view of a hospital bed mattress showing an example of a distribution of RFID tags on the mattress.

FIG. 8 shows one example of how multiple tags may be distributed laterally and longitudinally on mattress 50. Mattress upper body segment 52 has one tag 98 positioned at the expected location of the occupant's head. Mattress seat section 54 has three tags, one positioned at the expected locations of each of the occupant's ischeal tuberosities and one positioned at the expected location of the occupant's sacrum. Mattress calf section 58 has two tags, one positioned at the expected locations of each of the occupant's heels. Other arrangements of the tags may also be satisfactory, including arrangements in which one or more tags is adhered to the occupant or to an element of the occupant's sleepwear. There may be a one to one relationship between the quantity of tags and the quantity of readers, or the quantity of tags and the quantity of readers may be unequal to each other.

Figure 9:
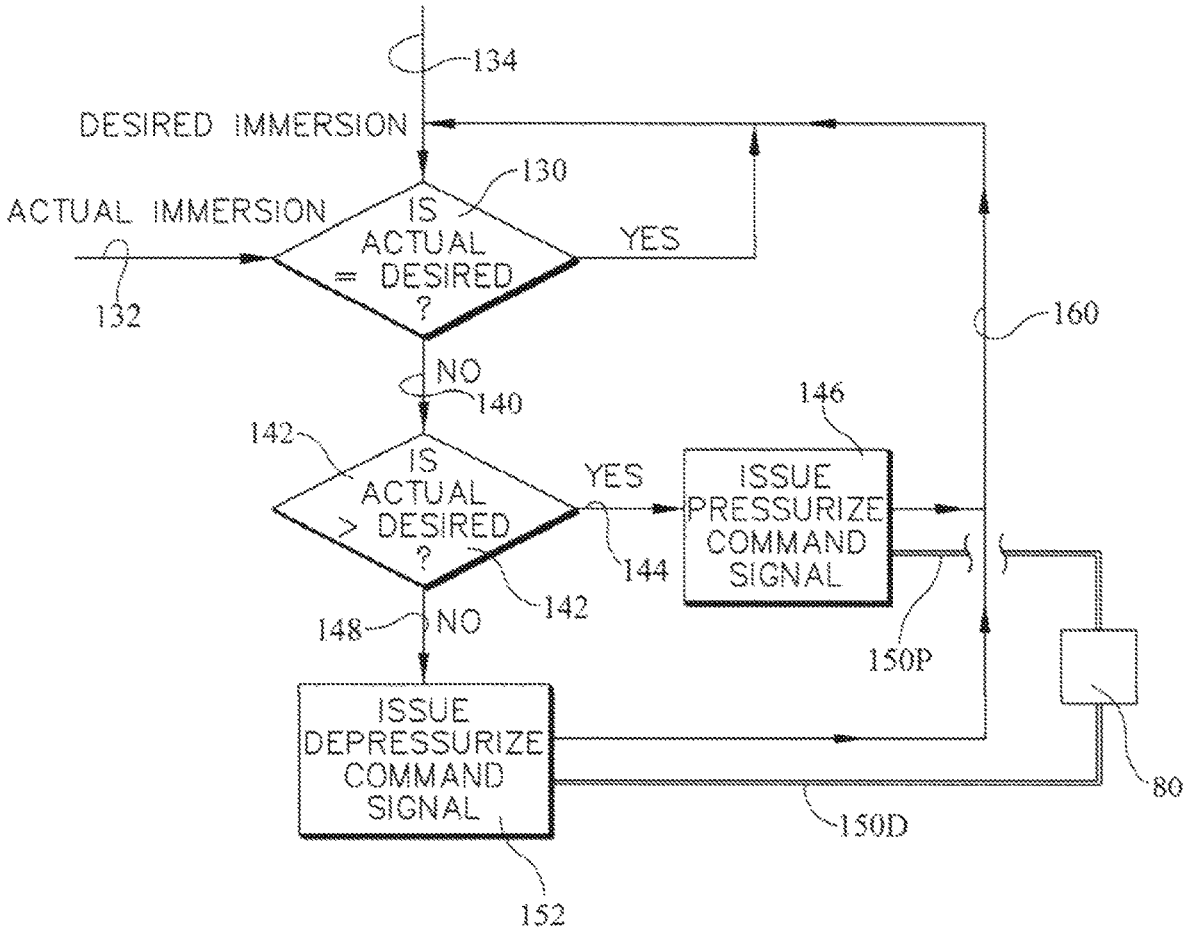
FIG. 9 is a block diagram showing a method, which may be carried out by a processor and instructions executed by a processor, for determining an immersion correction as a function of the return signal of FIG. 2, 5, 6, or 8 and for applying the immersion correction.
Figure 10:
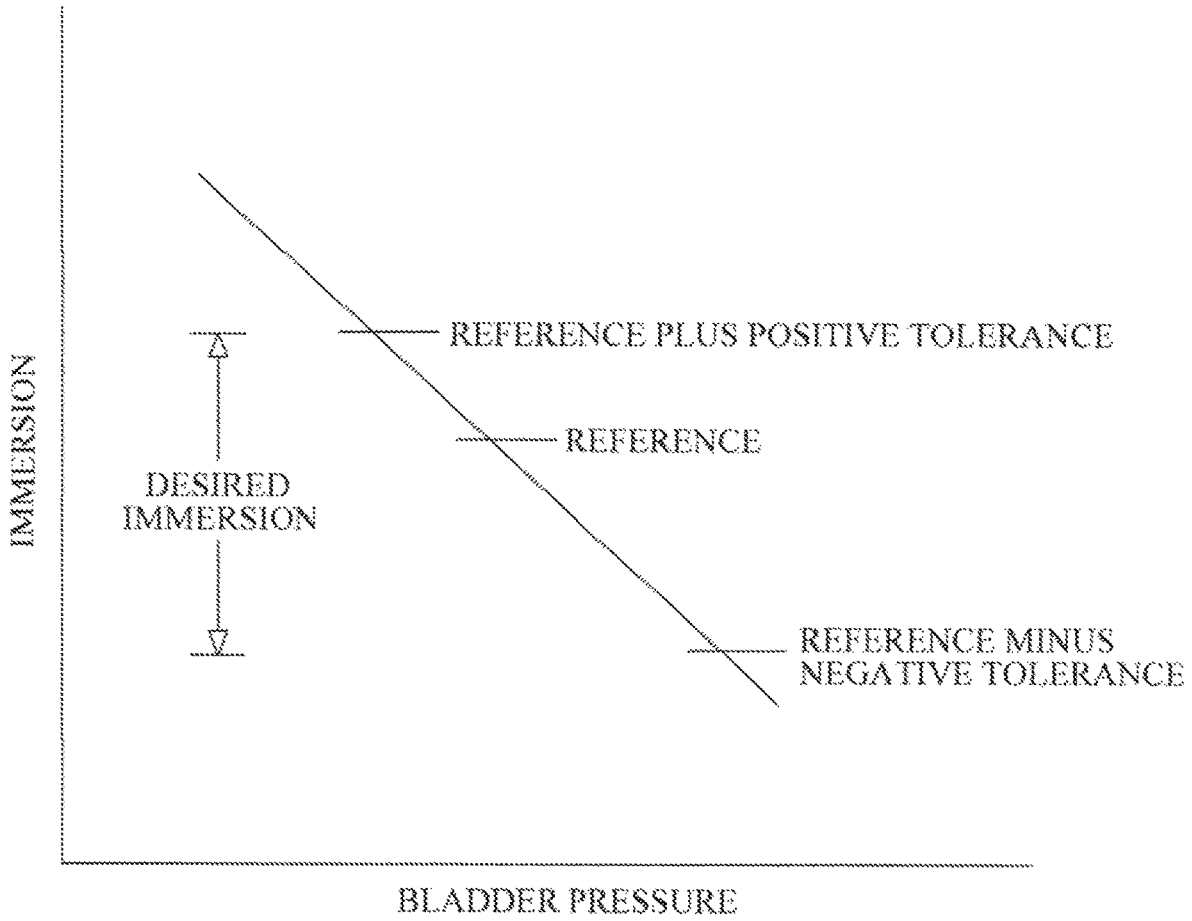
FIG. 10 is a graph showing desired immersion of a bed occupant as a function of bladder internal pressure.

Referring to the block diagram of FIG. 9 and the graph of FIG. 10, in yet another embodiment of the occupant support system the processor is adapted to also determine an immersion correction which guides an adjustment of fluid pressure inside one or more of the bladders with the objective of achieving a desired immersion.

At block 130 the processor, operating as directed by the executable instructions 114, determines if the actual immersion 132 of the target (e.g. the patient or an RFID tag) matches a desired immersion 134. The desired immersion is shown in FIG. 10 as a band having a reference immersion and specified positive and negative tolerances relative to the reference. The desired immersion may be a suitable or satisfactory immersion or it may be an optimum immersion. The sign convention is that both the positive and negative immersion tolerances are expressed as positive numbers, hence the lower limit of acceptability is calculated by subtracting the positively-signed negative tolerance from the desired immersion. The positive and negative tolerances may be equal to each other or may be unequal, as depicted in the illustration. FIG. 10 shows a linear relationship between immersion and bladder pressure, however the relationship may be nonlinear. In the following examples of various methods, the notion of a match between a desired immersion and an actual immersion means a match within some defined tolerance. Conversely the notion of a mismatch means that the actual immersion falls outside the tolerance band for the actual immersion. As a practical matter, those skilled in the art will understand that when an action is taken to bring an actual immersion into conformity with a desired immersion, it will likely be advantageous to continue the action until the actual immersion is well within the tolerance band rather than just inside the maximum or minimum limits of the band.

If the actual immersion of the target does not match the desired immersion the processor follows path 140 to block 142 where it determines if the actual immersion of the target is greater than the desired immersion. If so, the processor follows path 144 to block 146 where it issues a pressurization command signal 150P. The pressurization command signal commands an increase in the internal fluid pressure of one or more bladders, for example by commanding pump 80 to operate in a manner that supplies ambient air to the interior of the bladder. If the immersion of the target at block 142 is not greater than the desired immersion the processor follows path 148 to block 152 where it issues a depressurization command signal 150D which commands a decrease in the internal fluid pressure of the bladder. In one example the processor issues a command for pump 80 to operate in a manner that depressurizes the bladder by suctioning air from the interior of the bladder and exhausting it to ambient. In another example, not illustrated, the processor commands vent valve 82 to open in order to depressurize the bladder by venting fluid from the bladder. As used herein, the meaning of "depressurization" is not limited to complete evacuation of air from the bladder; it also refers to a reduction in pressure. In addition, it is well known that the phrases "less than" and "greater than" are often paired with a condition of equality (i.e. "or equal to"). In this specification, including the claims, unless indicated otherwise, use of phrases expressing an equality condition, such as "or equal to", with one of two complementary inequality phrases (e.g. "less than"/"greater than"; "not less than"/"not greater than") is intended to include use of the equality condition with the other of the complementary phrases instead of with the phrase that the equality condition is paired with in print.

While the bladder pressure is increasing as commanded at block 146, decreasing as commanded at block 152, or not changing at all, the method follows diagram branch 160 back to block 130 and continues to compare the actual immersion to the desired immersion. Once the pressurization or depressurization causes the actual immersion to equal the desired immersion, the processor withdraws the command 150P or 150D thereby discontinuing the pressurization or depressurization. The method also periodically re-establishes the occupant's actual immersion. The re-establishment of the occupant's actual immersion is carried out frequently enough to prevent overcorrection resulting from too much pressurization or depressurization of bladders and infrequently enough to limit the occupant's radiation exposure to acceptable levels.

The processor may also be adapted to issue a signal reporting an attribute of the determined immersion. In one example the attribute reported by the issued signal is a quantified indication of the immersion, for example the depth of immersion (as in FIGS. 4D and 7C) expressed in suitable units of distance. In another example the attribute is a status signal indicating the acceptability or unacceptability of the actual immersion. The graphs of FIGS. 4D and 7C show examples of a status signal, which is a function of the actual or determined immersion and a desired immersion. At a first end of each graph occupant immersion is too shallow to distribute the occupant's weight over a large enough surface area to guard against pressure ulcers. Therefore the processor issues a signal to indicate that immersion is insufficient (and/or bladder pressure is too high) to provide good protection against pressure ulcers. In the central region of each graph the immersion depth is close to the desired immersion depth. Therefore the processor issues a signal to indicate that immersion and/or bladder pressurization is satisfactory. At a second end of each graph the occupant is immersed deeply enough to be at risk of bottoming out, or to have actually bottomed out. Therefore the processor issues a signal to indicate that immersion is excessive (and/or bladder pressure is too low).

The desired immersion referred to above may be calculated from body parameters, i.e. parameters that describe the occupant's body, particularly morphological parameters. Such parameters include occupant weight W, occupant height h, occupant waist circumference $C_W$, occupant body mass index BMI, and occupant body shape index ABSI.

Body mass index, BMI, is the ratio of an occupant's weight W to the square of his height h:

$$\mathrm{BMI}=W/h^2 \tag{1}$$

A body shape index, ABSI is defined as waist circumference divided by the product of BMI to the ⅔ power and the square root of height (Krakauer and Krakauer "A New Body Shape Index Predicts Mortality Hazard Independently of Body Mass Index", PloS ONE 7(7): e39504. doi:10.1371/journal.pone.0039504, July, 2012):

$$\mathrm{ABSI}=CW/(\mathrm{BMI}^{2/3}h^{1/2}). \tag{2}$$

Figure 11:
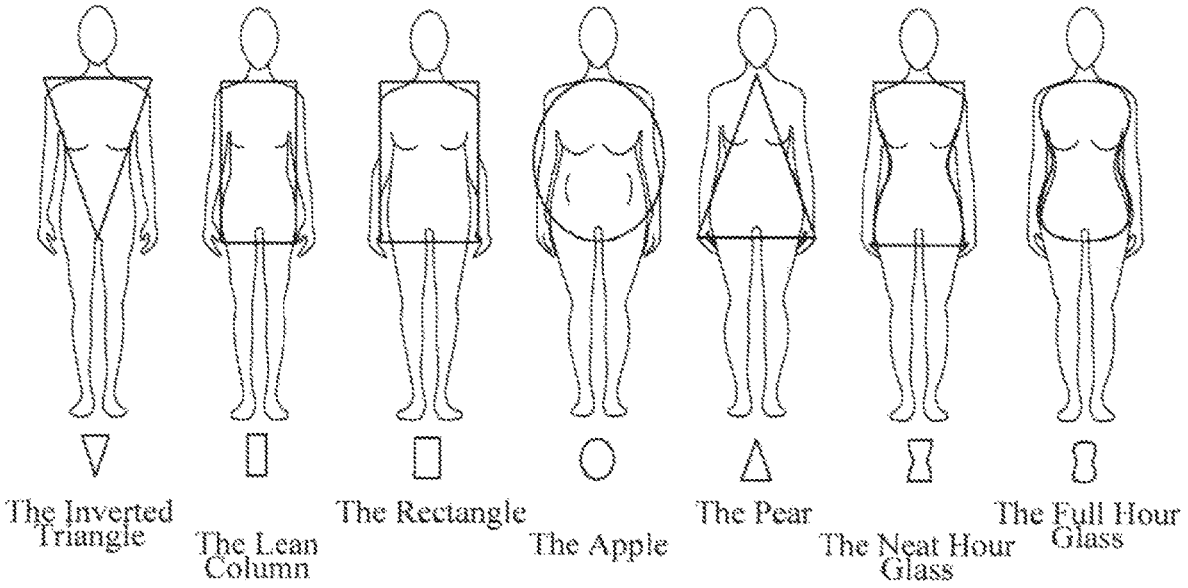
FIG. 11 is a display of qualitative assessments of body shape useful in the apparatuses and methods described herein.

Other, more qualitative indications of body shape may also be used as a guide to determination of the desired immersion of an occupant. Examples of qualitative assessments of body shape are shown in FIG. 11 (http://www.joyofclothes.com/style-advice/shape-guides/body-shapes-overview.php).

Figure 12:
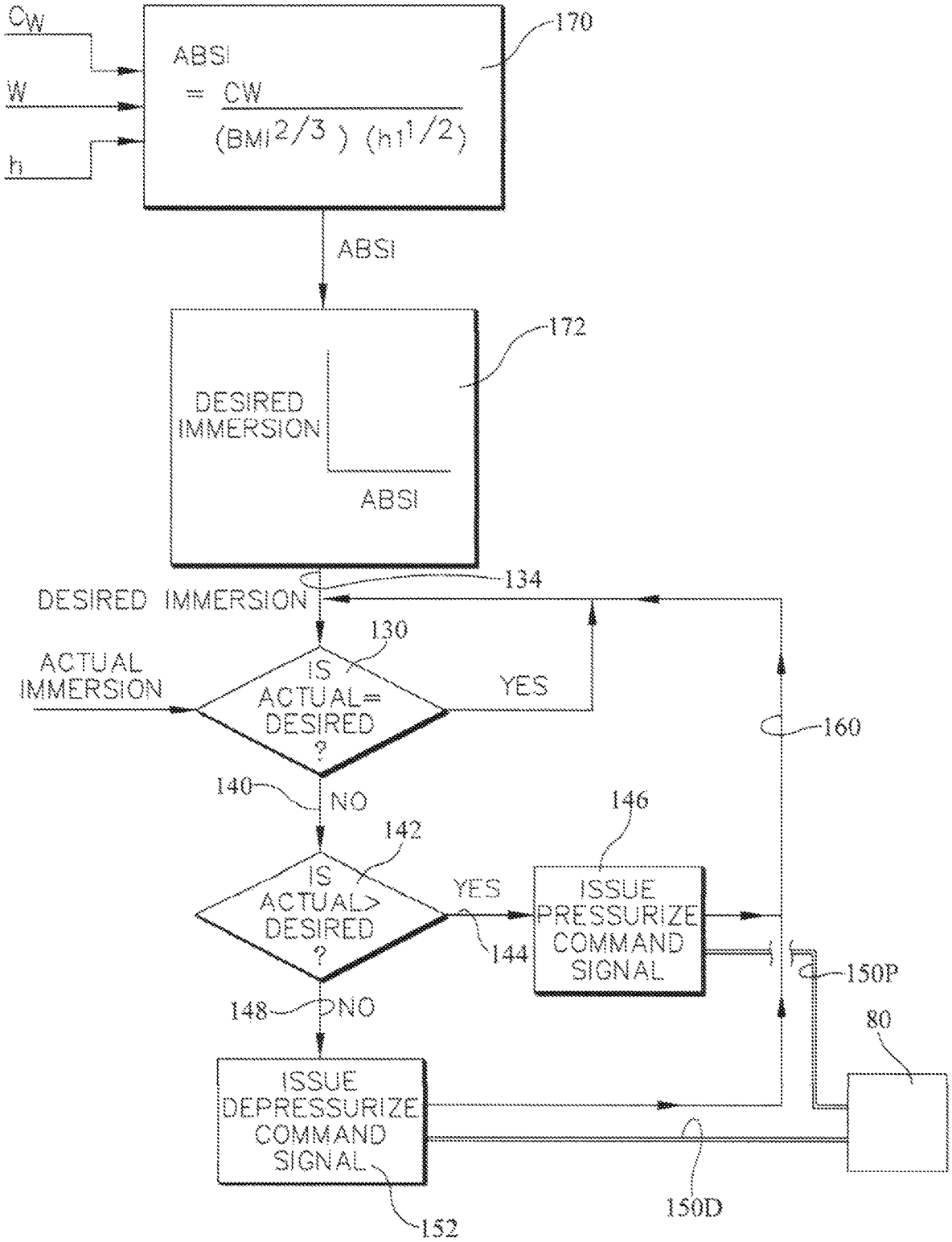
FIG. 12 is a block diagram similar to that of FIG. 9 showing one example of the methodology carried out by a processor when it executes machine readable instructions and in which the desired immersion depth is a calculated quantity.

FIG. 12 is a block diagram similar to that of FIG. 9 showing another example of the methodology carried out by processor 110 when it executes machine readable instructions 114. At block 170 the processor computes or otherwise acquires a body parameter. The example of FIG. 11 uses a computed body parameter, namely ABSI as defined above. At block 172 the processor consults a relationship relating desired immersion to ABSI. The desired immersion is communicated to block 130. The balance of the diagram beginning at block 130 is the same as the diagram of FIG. 9, and its operation is the same as described above in connection with FIG. 9.

Figure 13:
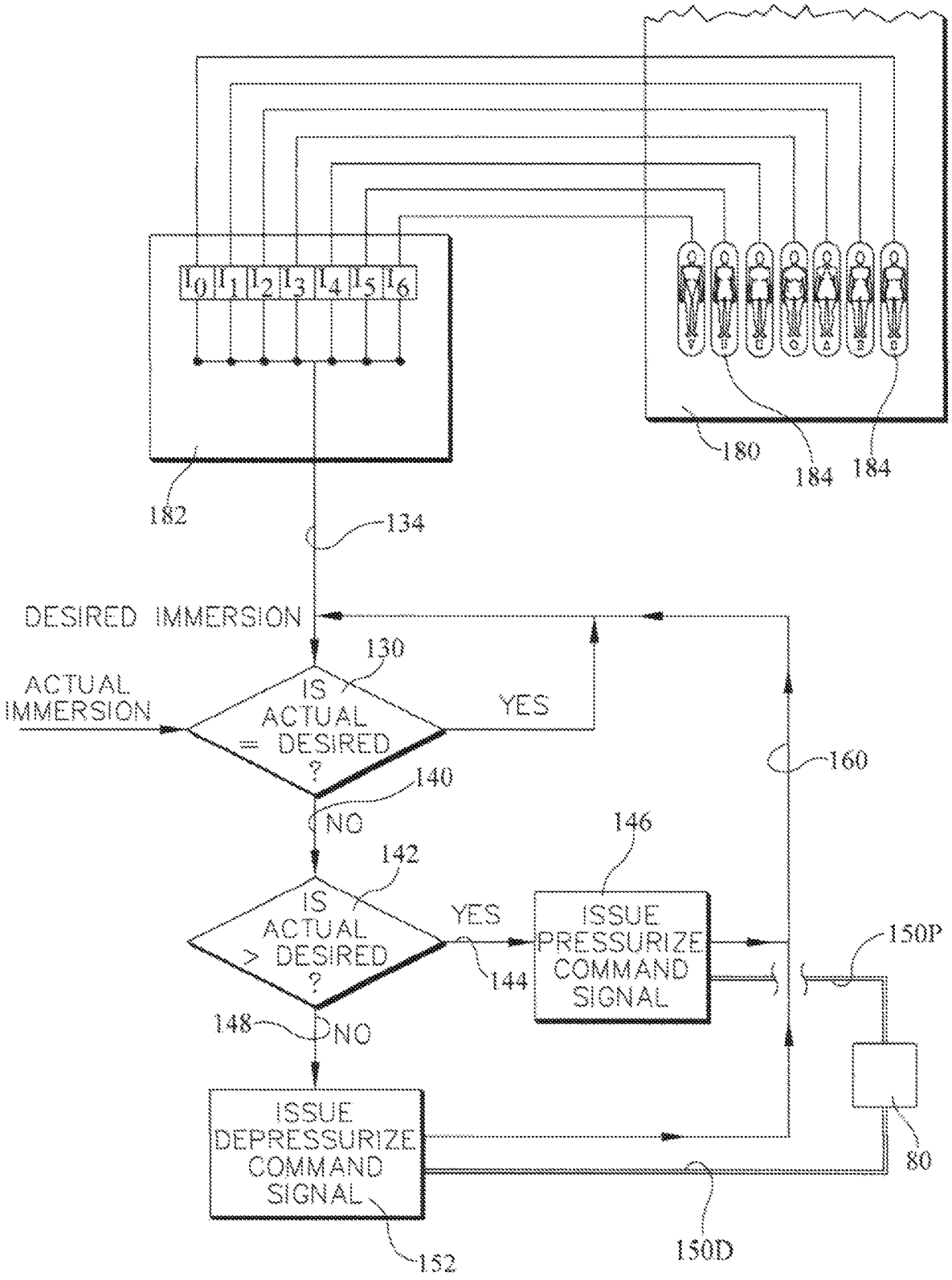
FIG. 13 is a block diagram similar to that of FIG. 12 except that the desired immersion is based on a qualitative assessment which employs the body shapes of FIG. 11.

FIG. 13 is a block diagram similar to that of FIG. 12 except that blocks 180 and 182 take the place of blocks 170 and 172 of FIG. 12. Block 180 shows a portion of a user interface having buttons 184 corresponding to the body shapes of FIG. 11. A user presses a selected button to indicate his perception of the shape of the bed occupant. A signal representing the selection is communicated to block 182 and causes a desired immersion depth value, appropriate to the indicated body shape, to be delivered to block 130. The balance of the diagram beginning at block 130 is the same as the diagram of FIG. 9, and its operation is the same as described above in connection with FIG. 9.

Figure 14:
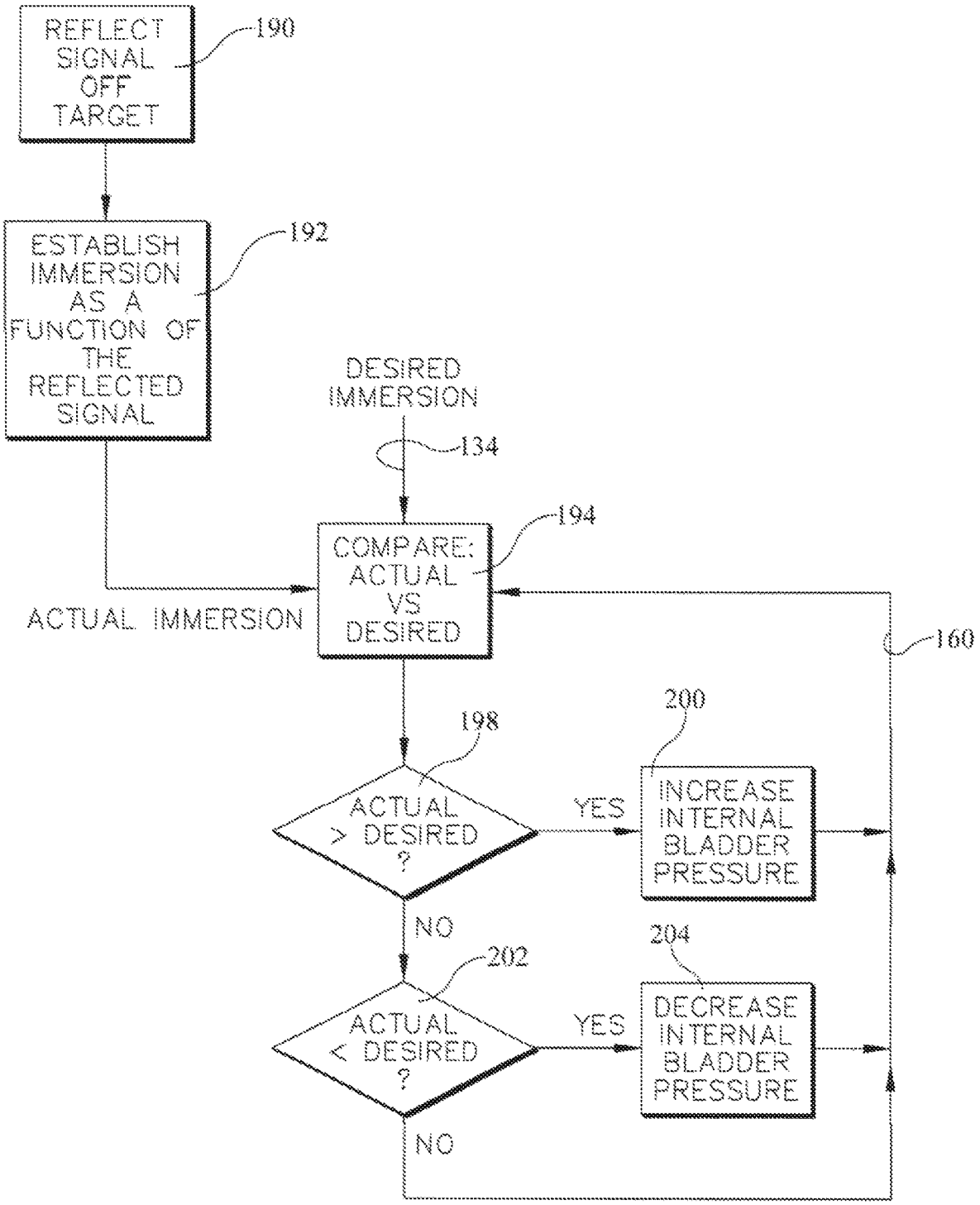
FIG. 14 is a block diagram showing a method of managing bladder pressure in an occupant support having one or more support bladders, the method involving reflecting an electromagnetic signal off an occupant of the occupant support.

FIG. 14 is a block diagram showing a method of managing bladder pressure in an occupant support having one or more support bladders, or, alternatively, a method of managing the risk of skin damage to an occupant of an occupant support having one or more support bladders. At blocks 190 and 192 the method determines the actual immersion of the occupant. More specifically, at block 190 the method includes the step of reflecting an electromagnetic signal (e.g. signal $S_E$ of FIG. 2) off a target such as the bed occupant as already described in connection with FIGS. 2, 3 and 4A-4D. The signal may be an RF signal. At block 192 the method includes the step of establishing occupant immersion as a function of the reflected signal, for example as described in connection with FIGS. 4A-4D. At block 194 the method compares the determined immersion to a desired immersion. At block 198, if the actual immersion is greater than the desired immersion, the method proceeds to block 200 and issues a command to increase internal pressure in at least one of the support bladders. However if the test at block 198 reveals that actual immersion is not greater than the desired immersion, the method proceeds to block 202. At block 202, if the immersion is less than the desired immersion, the method proceeds to block 204 and issues a command to decrease internal pressure in at least one of the support bladders. Otherwise the method follows path 160 and continues to compare the actual immersion to the desired immersion. As noted previously the system also periodically re-establishes the actual immersion at blocks 190, 192.

Figure 15:
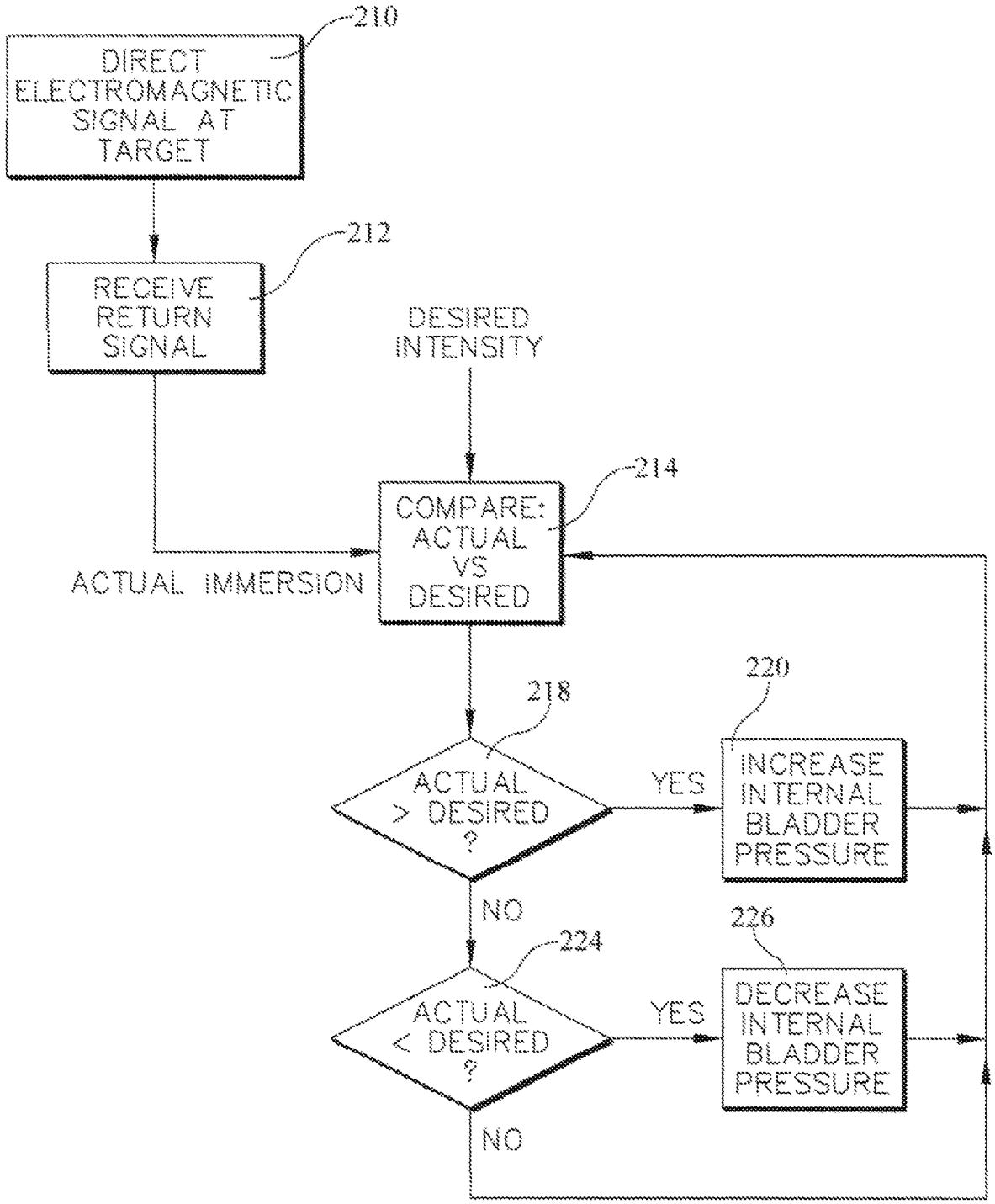
FIG. 15 is a block diagram similar to that of FIG. 14 showing a method of managing the risk of skin damage to an occupant of an occupant support having one or more support bladders, the method involving determining immersion of the as a function of the frequency at which a signal strength extremum is present in a return signal from an RFID tag.

FIG. 15 is a block diagram similar to that of FIG. 14, showing a method of managing the risk of skin damage to an occupant of an occupant support having one or more support bladders or, alternatively, a method of managing bladder pressure in an occupant support having one or more support bladders. At block 210 the method includes the step of directing an electromagnetic signal at a target. The signal may be an RF signal and the target may be, for example, the occupant or an RFID tag. At block 212 the method receives a return signal from the target in response to the directed signal. At block 214 the method compares the actual immersion of the occupant, as indicated by the return signal, to the desired immersion, for example as described in connection with FIGS. 5, 6, and 7A-7C. At block 218, if the actual immersion is greater than the desired immersion, the method proceeds to block 220 and issues a command to increase internal pressure in at least one of the support bladders. However if the test at block 218 reveals that actual immersion is not greater than the desired immersion, the method proceeds to block 224. At block 224, if the immersion is less than the desired immersion, the method proceeds to block 226 and issues a command to decrease internal pressure in at least one of the support bladders. Otherwise the method follows path 160 and continues to compare the actual immersion to the desired immersion. As noted previously the system also periodically re-establishes the actual immersion by carrying out the directing and receiving steps at blocks 210, 212.

Figure 16:
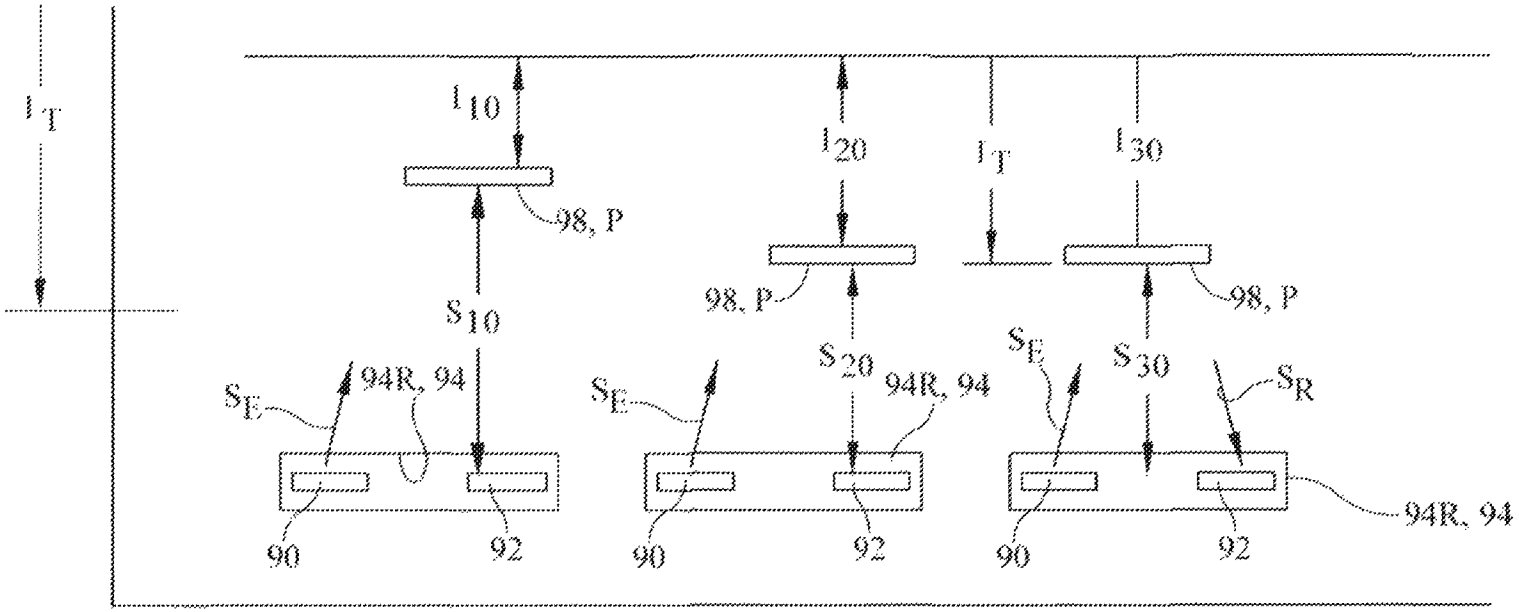
FIG. 16 is a set of schematics illustrating an arrangement and a method in which a signal receiver and a target are configured so that the receiver receives a discernible return signal only if the separation between the target and the receiver is less a designated distance.
Figure 17:
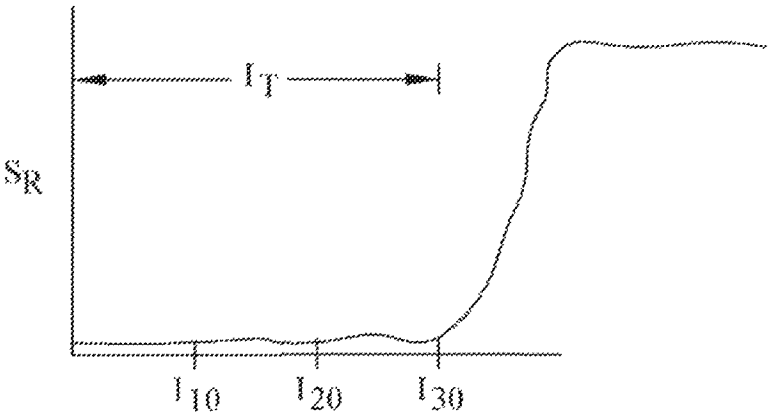
FIG. 17 is a graph showing an example of return signal intensity of the embodiment of FIG. 16 as a function of immersion depth.

FIGS. 16-17 illustrate a variant of the method in which the journey from emitter 90 to receiver 92 can be completed only if the target (e.g. occupant or RFID tag) and receiver are separated by no more than a specified threshold distance. If the emitter and receiver are separated by a greater distance the return signal is too weak to be reliably perceived by receiver 92. Therefore the communication cannot take place. FIG. 16 illustrates a target such as RFID tag 98 at three immersion depths, $I_{10}$, $I_{20}$, $I_{30}$ corresponding to separation distances between target and receiver of $S_{10}$, $S_{20}$, $S_{30}$. In all three cases, signal generator 90 emits a signal $S_E$ directed at the target. Receiver 92 monitors for a return signal from the target. When the target is at immersion depths $I_{10}$ and $I_{20}$ there is no return signal discernible by receiver 92. However when the target reaches a threshold immersion depth $I_T$, illustrated as equivalent to $I_{30}$, the receiver receives a discernible return signal $S_R$. Assuming that the components are configured so that $I_T$ is a meaningful depth (e.g. $I_T$ is the minimum immersion required to achieve acceptable interface pressure, or the maximum immersion at which interface pressure is acceptably low without undue risk of bottoming out) the detection of the return signal at receiver 92 indicates that that meaningful immersion depth has been achieved. According to a method of operation, if the return signal is not detected, the processor commands a decrease of internal pressure in at least one of the one or more support bladders until a signal is detected. For target immersions greater than $I_T$, the strength of the return signal $I_R$ can be used to gauge the actual immersion depth of the target. FIG. 16 is a graph illustrating the absence of a discernible return signal $S_R$ until the immersion of the target is at least $I_{30}$.

In the foregoing example of the threshold based method the target is an RFID tag as the target. However the principles of the threshold based method apply equally if the target is the occupant.

Although this disclosure refers to specific embodiments, it will be understood by those skilled in the art that various changes in form and detail may be made without departing from the subject matter set forth in the accompanying claims.

We claim:

1. An occupant support system comprising: a framework; a mattress supported by the framework, the mattress having a framework facing side and an occupant facing side, the mattress comprised of at least one bladder; an electromagnetic signal source; an electromagnetic signal receiver, the receiver being spaced from the occupant facing side of the mattress; the signal source configured to direct an electromagnetic signal at a target; the signal receiver configured to receive a return signal from the target in response to the directed signal, the return signal having an information content; and a processor adapted to determine immersion of the target as a function of the information content of the return signal; wherein the return signal is a reflection of the directed signal, and the determined immersion is only a function of the frequency at which a signal strength extremum is present in the return signal.

2. The occupant support system of claim 1 wherein the processor is adapted to also determine an immersion correction as a function of the information content of the return signal.

3. The occupant support system of claim 2 wherein the correction is used to guide an adjustment of fluid pressure inside at least one of the at least one bladders so that:

if the immersion of the target is greater than a desired immersion by more than a positive tolerance, the processor commands an increase in the fluid pressure, and if the immersion of the target is less than a desired immersion by more than a negative tolerance, the processor commands a decrease in the fluid pressure.

4. The occupant support system of claim 3 including a pump and wherein the command to increase fluid pressure is a command to operate the pump in a manner to increase the amount of fluid inside the at least one of the at least one bladders.

5. The occupant support system of claim 4 wherein the command to decrease fluid pressure is a command to operate the pump in a manner to decrease the amount of fluid inside the at least one of the at least one bladders.

6. The occupant support system of claim 4 wherein the command to decrease fluid pressure is a command to vent fluid from the at least one of the at least one bladders.

7. The system of claim 1 wherein the target is an occupant of the occupant support.

8. The occupant support system of claim 1 wherein the target is a mattress component whose spatial relationship relative to the signal receiver depends on attributes of a distributed load applied to the mattress and fluid pressure inside at least one of the at least one bladders.

9. The occupant support system of claim 1 wherein the electromagnetic signal source and the electromagnetic signal receiver are mounted on the framework.

10. The occupant support system of claim 1 wherein the electromagnetic signal source and the electromagnetic signal receiver are components of the mattress.

11. The occupant support system of claim 1 wherein the processor is also adapted to produce a status signal as a function of the determined immersion and a desired immersion.

12. The occupant support of claim 1 wherein the extremum is a valley.

13. The occupant support of claim 1 wherein the extremum is selected from return signals arising from a frequency scan.

* * * * *